US005531666A

United States Patent [19]

Hung

[11] Patent Number: 5,531,666

[45] Date of Patent: Jul. 2, 1996

[54] TOWELS HAVING A MASSAGE DEVICE DISPOSED THERETO

[76] Inventor: Chien-chuan Hung, No. 8, Lane 782, Sec. 2, Chunghwa Rd., Taitung, Taiwan

[21] Appl. No.: 438,096

[22] Filed: May 8, 1995

[51] Int. Cl.[6] ..... A61H 7/00; A61H 15/00

[52] U.S. Cl. ..... 601/129; 601/118; 601/120; 601/135

[58] Field of Search ..... 601/118–124, 128, 601/129, 134–136, 154, 17, 70–72, 74, 78, 80; 15/222, 160

[56] References Cited

U.S. PATENT DOCUMENTS

| | | | |
|---|---|---|---|
| 1,724,893 | 8/1929 | Baginski | 601/119 |
| 1,741,962 | 12/1929 | Theodoropulos | 601/154 X |
| 1,965,918 | 7/1934 | Auberger | 601/119 |
| 2,221,785 | 11/1940 | Douglas | 601/120 |
| 2,544,216 | 3/1951 | Brackmann | 15/222 |
| 3,024,486 | 3/1962 | Naugle | 15/222 |
| 3,636,945 | 1/1972 | Sato | 601/71 |
| 3,720,205 | 3/1973 | Liebman | 601/154 X |
| 3,812,849 | 5/1974 | Guinta | 601/154 X |
| 3,959,841 | 6/1976 | Horne | 601/154 X |
| 4,016,622 | 4/1977 | Eisenman | 15/222 |
| 4,196,490 | 4/1980 | Jonzon | 15/222 |
| 4,974,279 | 12/1990 | Mathison | 15/222 X |
| 5,295,280 | 3/1994 | Hudson et al. | 601/154 X |
| 5,411,470 | 5/1995 | Liptak et al. | 601/118 |
| 5,413,551 | 5/1995 | Wu | 601/70 X |

*Primary Examiner*—Mickey Yu
*Assistant Examiner*—Brian E. Hanlon
*Attorney, Agent, or Firm*—Kirkpatrick & Lockhart

[57] ABSTRACT

A towel having a massage device disposed thereto, the massage device is an egg-like element composed of a first compartment and a second compartment and has two ends, from each of which a towel rotatably extends,the towels each have a block disposed in the massage device via a hole defined in the corresponding end, the massage device has a plurality of bosses extending from an outer surface thereof and has a plurality of apertures defined therein such that the massage device is rotatable corresponding to a longitudinal axis of the two towels.

2 Claims, 4 Drawing Sheets

TOWELS HAVING A MASSAGE DEVICE DISPOSED THERETO

BACKGROUND OF THE INVENTION

The present invention relates to a towel and more particularly, to a towel having a rotatable massage device disposed thereto.

There are many kinds of auxiliary products used in taking a bath, such as a sponge or a towel, to clean our body, in fact, one of the primary objects to take a bath of a shower is to relax the body and spirit after a day's hard work, therefore, some people use a massage bathtub, such as a jacuzzi, to get advantages of being massaged. However, the massage bathtub is not commonly available for an average person because of its high cost, although most people would like to have a massage when taking a bath.

The present invention intends to provide a towel having a massage device disposed thereto such that the user may use the massage device to roll over his/her body to get a massage effect so as to mitigate and/or obviate the above-mentioned problems.

SUMMARY OF THE INVENTION

The present invention provides a towel having a massage device disposed thereto, the massaage device is an egg-like element composed of a first compartment and a second compartment and has two ends, from each of which a towel rotatably extends which has a block disposed in the massage device via a hole defined in the corresponding end, the massage device has a plurality of bosses extending from an outer surface thereof and has a plurality of apertures defined therein such that the massage device is rotatable corresponding to a longitudinal axis of the two towels.

It is an object of the present invention to provide a towel having an egg-like massage device rotatably disposed thereto such that when using the towel the massage device is operated to roll over a user's body.

Other objects, advantages, and novel features of the invention will become more apparent from the following detailed description when taken in conjunction with the accompanying drawings.

DETAILED DESCRIPTION OF THE PREFERRED EMBODIMENT

Figure 1:
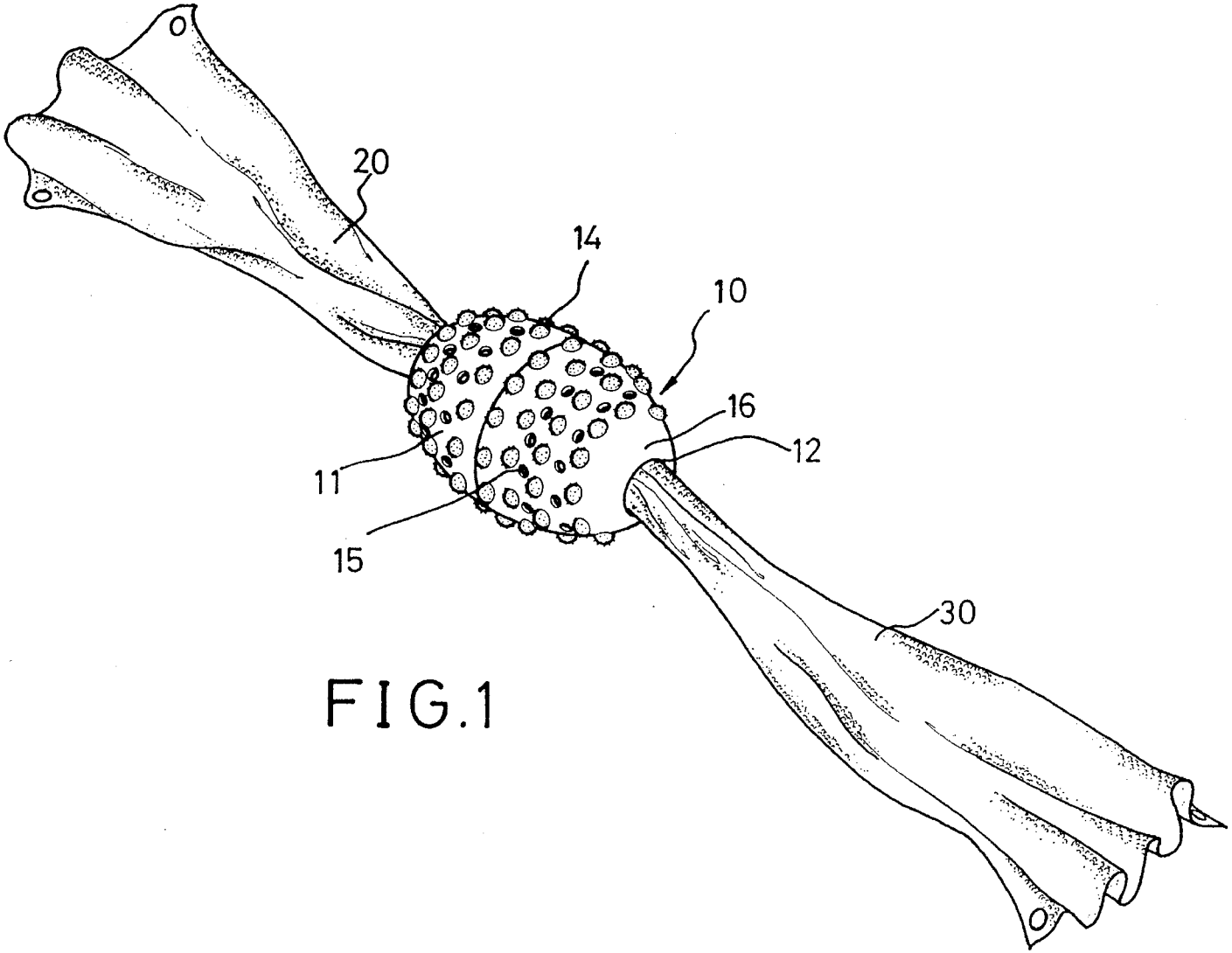
FIG. 1 is a perspective view of a towel having a massage device disposed thereto in accordance with the present invention.
Figure 2:
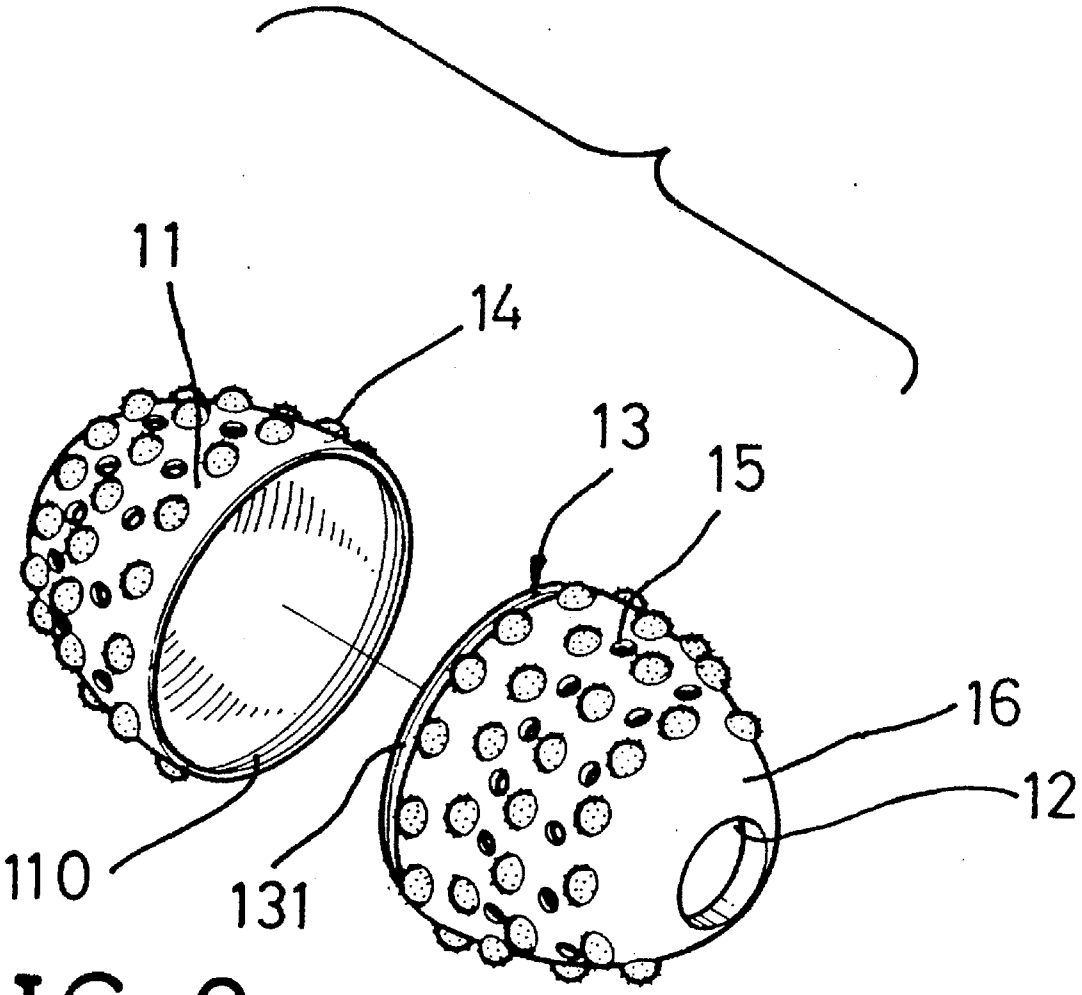
FIG. 2 is an exploded view of the massage device in accordance with the present invention.
Figure 3:
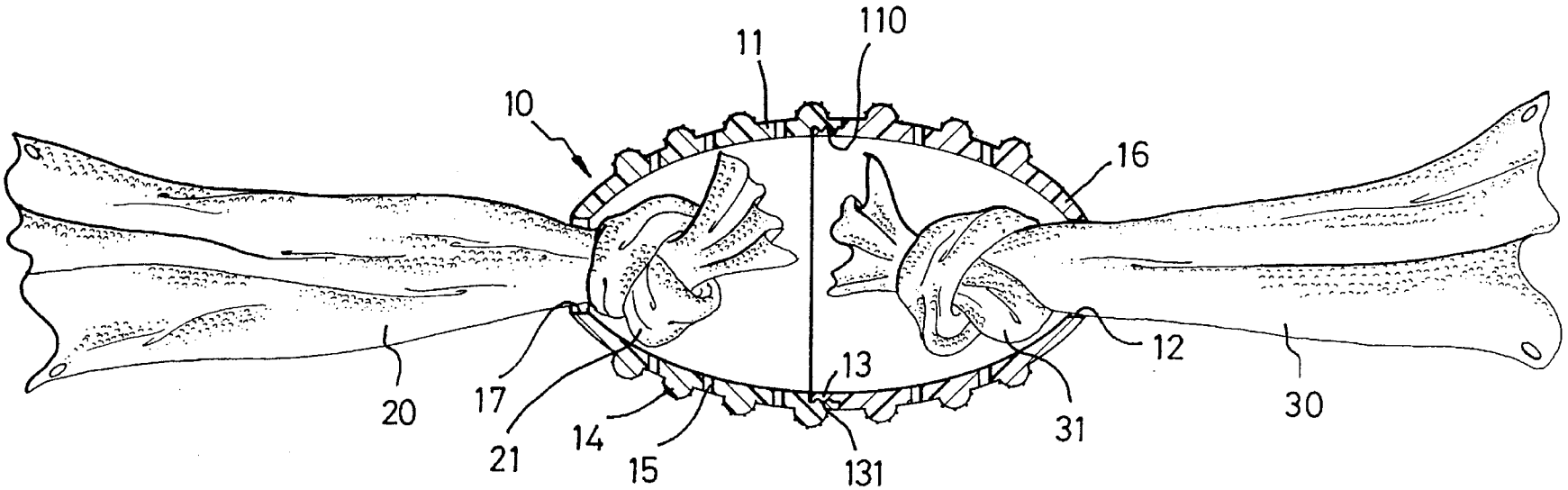
FIG. 3 is a side elevational view, partly in section, of the towel having a massage device disposed thereto in accordance with the present invention.

Referring to the drawings and initially to FIGS. 1 through 3, a towel having a massage device disposed thereto in accordance with the present invention generally includes an egg-like massage device 10 and two towels 20, 30, the massage device 10 comprising a first compartment 11 and a second compartment 16, each of the first compartment 11 and the second compartment 16 having a plurality of bosses 14 extending outwardly from an outer surface thereof and having a plurality of apertures 15 defined in the outer surface thereof. The first compartment 11 has a first end and a second end, the first end thereof being an open end and having a first engaging structure, a first threaded portion 110 for example, defined in an inner periphery thereof and the second end thereof having a first hole 17 defined therein communicating with the first end. The second compartment 16 has a first end and a second end, the first end thereof being an open end and having a second engaging structure which includes a flange 13 extending from the first end of the second compartment 16 and the flange 13 having a second threaded portion 131 defined in an outer periphery thereof for threadedly engaging with the first threaded portion 110 of the first end of the first compartment 11 and, the second end of the second compartment 16 having a second hole 12 defined therein communicating with the first end of the second compartment 16.

A first towel 20 has one end thereof knotted to form a block 21 disposed in the first compartment 11 via the first hole 17 and a second towel 30 has one end thereof knotted to form a block 31 disposed in the second compartment 16 via the second hole 12 such that the massage device 10 is rotatably disposed to the first towel 20 and the second towel 30.

Figure 4:
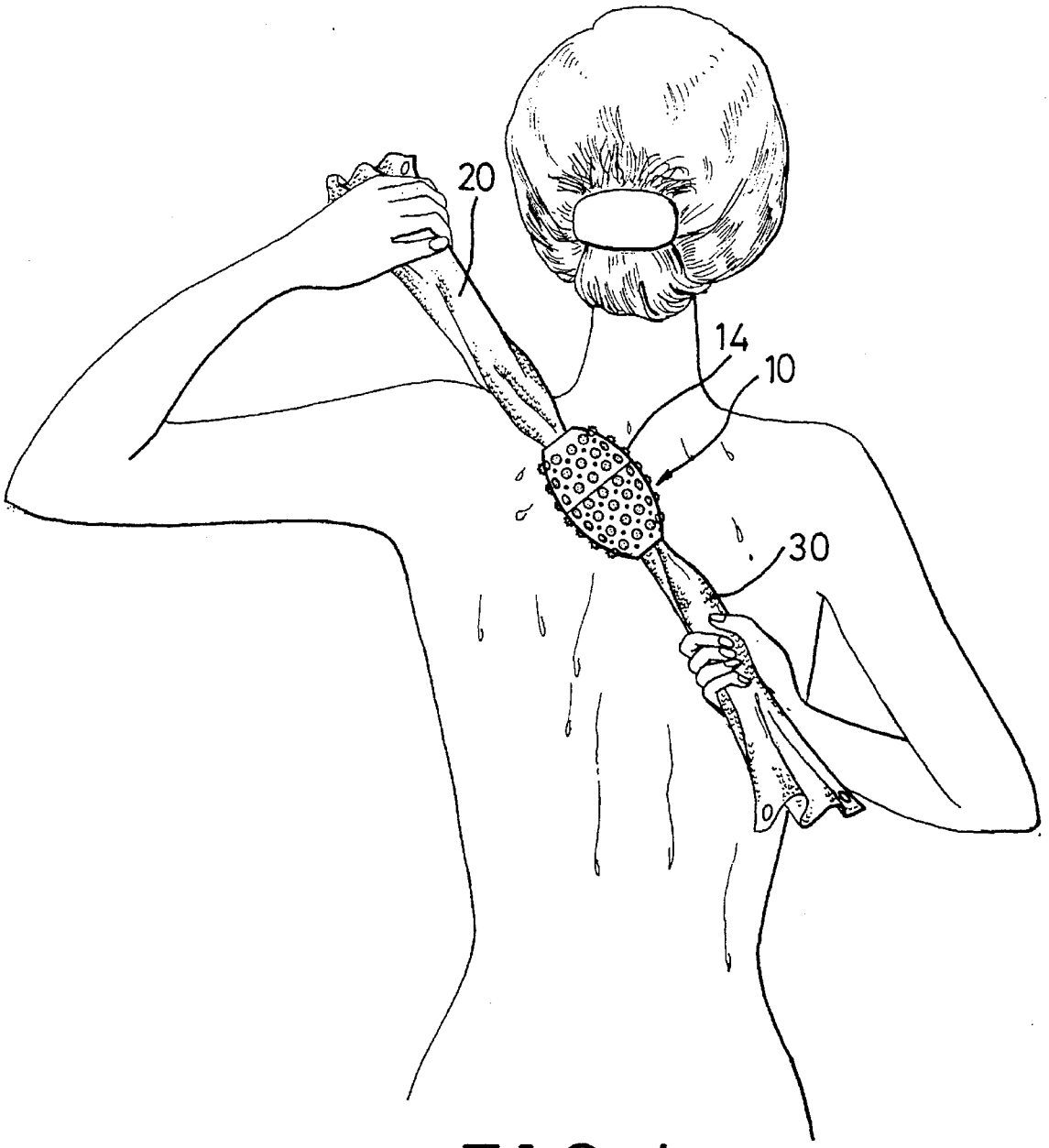
FIG. 4 is an illustrative view of the towel having a massage device disposed thereto is used by a user.

Referring now to FIG. 4, when using the towel having a massage device disposed thereto in accordance with the present invention, a user holds the first towel 20 and the second towel 30 with his/her hands respectively to roll the massage device 10 over his/her body and receives a massage effect by the bosses 14 pressing the muscles of the user.

Although the invention has been explained in relation to its preferred embodiment, it is to be understood that many other possible modifications and variations can be made without departing from the spirit and scope of the invention as hereinafter claimed.

I claim:

1. In combination, a first towel, a second towel, and a massage device disposed between said first and said second towels:

said massaage device comprising a first compartment and a second compartment, each of said first compartment and said second compartment having a plurality of bosses extending outwardly from an outer surface thereof and having a plurality of apertures defined in said outer surface thereof, said first compartment having a first end and a second end, said first end thereof being an open end and having a first engaging structure defined therein and said second end thereof having a first hole defined therein communicating with said first end, said second compartment having a first end and a second end, said first end of said second compartment being an open end and having an engaging structure defined there in for engagement with said first engaging structure of said first compartment and said second end of said second compartment having a hole defined therein communicating with said first end of said second compartment, and said first towel having one end thereof tied into a knot and disposed in said first compartment via said first hole and said second towel having one end thereof tied into a knot and disposed in said second compartment via said second compartment hole.

2. The combination as claimed in claim 1 wherein said first engaging structure is a first threaded portion defined in an inner periphery of said first end of said first compartment and said second compartment engaging structure includes a flange extending from said first end of said second compartment and said flange having a second threaded portion defined in an outer periphery thereof for threadedly engaging to said first threaded portion of said first end of said first compartment.

* * * * *

UNITED STATES PATENT AND TRADEMARK OFFICE

CERTIFICATE OF CORRECTION

PATENT NO. : 5,531,666
DATED : July 2, 1996
INVENTOR(S) : Chien-chuan Hung

It is certified that error appears in the above-indentified patent and that said Letters Patent is hereby corrected as shown below:

Col. 2, line 42, delete "massaage" and substitute therefor --massage--.

Signed and Sealed this

Third Day of December, 1996

Bruce Lehman

*Attest:*

BRUCE LEHMAN

*Attesting Officer*

*Commissioner of Patents and Trademarks*